US009200396B2

(12) United States Patent
McCue

(10) Patent No.: US 9,200,396 B2
(45) Date of Patent: Dec. 1, 2015

(54) SPOOL-LESS, CONTINUOUS BOBBIN ASSEMBLY AND METHOD OF USE

(71) Applicant: Geoff McCue, Lawrence, KS (US)

(72) Inventor: Geoff McCue, Lawrence, KS (US)

( * ) Notice: Subject to any disclaimer, the term of this patent is extended or adjusted under 35 U.S.C. 154(b) by 79 days.

(21) Appl. No.: 14/043,404

(22) Filed: Oct. 24, 2013

(65) Prior Publication Data

US 2014/0209234 A1 Jul. 31, 2014

Related U.S. Application Data

(60) Provisional application No. 61/758,629, filed on Jan. 30, 2013.

(51) Int. Cl.

| | |
|---|---|
| ***D05C 3/00*** | (2006.01) |
| ***D05B 57/00*** | (2006.01) |
| ***D05C 11/00*** | (2006.01) |

(52) U.S. Cl.

CPC *D05C 3/00* (2013.01); *D05B 57/00* (2013.01); *D05C 11/00* (2013.01); *Y10T 156/15* (2015.01)

(58) Field of Classification Search

CPC ..... B29C 65/00; B29C 65/02; B29C 65/18; B29C 66/729; B29C 65/48; B29C 65/4815; B29C 65/04; D04H 18/00; D04H 3/00; D04H 5/06; D04H 1/46; D05B 17/00; D05B 65/006; D05B 13/00; D05B 15/00; D05B 23/00; D05B 29/06; D05B 35/04; D06C 23/00; D06C 2700/31; D06C 5/005; D06C 7/04; D02G 3/40; D02G 3/402; D02G 3/46; D02G 3/02; D02G 3/18; D02G 3/36; D02G 3/404; D02G 3/445; D04B 1/225; D04B 9/44; D04B 15/80; D04B 1/04; D04B 1/16; D04B 1/18; D04B 1/02; D06M 17/00; D06M 17/06; D06M 17/10; D06M 23/00; D06M 23/08; D06M 23/18; D10B 2501/0632; D10B 2505/02; D10B 2101/06; D10B 2331/04; D10B 2401/041; D10B 2403/0311; D10B 2501/044; D10B 2503/042; A41D 27/24; A41D 27/245

USPC ..... 112/164, 41, 280, 281; 156/282, 320, 156/321, 322, 345.37, 583.1, 583.7, 583.9

See application file for complete search history.

(56) References Cited

U.S. PATENT DOCUMENTS

| | | | | |
|---|---|---|---|---|
| 3,509,840 | A * | 5/1970 | Rovin | 112/181 |
| 2003/0221765 | A1* | 12/2003 | Guilhem et al. | 156/93 |
| 2005/0008823 | A1* | 1/2005 | Schwar | 428/156 |

* cited by examiner

*Primary Examiner* — Vishal I Patel

(74) *Attorney, Agent, or Firm* — Christina Chamberlain; Chamberlain Legal Services, PLLC

(57) ABSTRACT

The present invention is a spool-less, continuous bobbin assembly and a method of use for forming a stitch in a stitching surface. The spool-less, continuous bobbin assembly is generally comprised of a needle assembly for an upper thread, a looping assembly for the upper thread and an application assembly to deposit a lower thread material onto a stitching surface.

9 Claims, 9 Drawing Sheets

SPOOL-LESS, CONTINUOUS BOBBIN ASSEMBLY AND METHOD OF USE

RELATED APPLICATIONS

This application claims priority to U.S. Provisional Application No. 61/758,629 filed Jan. 30, 2013. The entire contents of the above application are hereby incorporated by reference as though fully set forth herein.

FIELD

The present invention relates generally to the field of sewing and embroidery. More specifically the present invention is a spool-less, continuous bobbin assembly and a method of use to form a stitch in a stitching surface.

BACKGROUND

Traditionally, sewing and embroidery requires the use of an upper and lower thread. The upper thread is pushed through a needle where it is moved up and down through the sewing foot and fabric being sewn. The lower thread is wound on a spool called a bobbin. The entire bobbin assembly consists of housing, rotating hook, spool and casing. The upper thread is moved downward into the bobbin case, where the hook grabs the thread and feeds it around the spool to form a loop, which is then tightened around the lower thread.

Since the upper thread must loop around the lower thread, the lower thread cannot be continuous. Therefore, the bobbin spool must be wound with a limited amount of thread. The spool can now be wrapped by the upper thread to meet and form a stitch. The problem with this traditional approach is that the bobbin spool, having a limited amount of thread, must be constantly replaced. Since the upper thread doesn't have any limitations, large spools or skeins can be utilized for longer sewing times. Bobbin threads are also subject to breakage and the casing becomes filled with lint and thread scraps.

It is therefore an object of the present invention to introduce a new, inventive concept that replaces the lower thread with a reactive material, such as self bonding, phase change or fusible compounds. (ie. polyester, nylon, acrylic or copolymer, etc.), that can be inserted by rolling; pumping; or pushing the material into the space previously occupied by the lower thread. This material, in a fiber form, can be heated at the tip of a tube that brings it into position and deposited to the previous bead and extended to capture the loop from the upper thread. A phase change material (liquid to solid or solid to solid) exhibits the best characteristics.

BRIEF SUMMARY OF THE INVENTION

It is the object of the present invention to address the challenge presented by a traditional spooled bobbin sewing or embroidery machine system. The present invention is a spool-less bobbin apparatus for forming a stitch in a piece of fabric or other material suitable to receive a stitch, the apparatus generally comprised of a needle assembly for an upper thread, a looping assembly for the upper thread and an application assembly to deposit a lower thread material onto a stitching surface. The present invention further comprises a method for forming a stitch in a piece of fabric or other suitable material to receive a stitch wherein an upper thread is passed through a stitching surface from a first side to a second side of a stitching surface, a loop is formed in the upper thread on the second side of the stitching surface, a lower thread material is deposited on the second side of the stitching surface and the upper thread loop is closed around (and in some cases embedded within) the lower thread material by passing the upper thread back through the stitching surface from the second side to the first side of the stitching surface.

In a preferred embodiment of the present invention, the apparatus further includes a heating apparatus that heats the lower thread material. The lower thread material can be a reactive material, such as self bonding, phase change or fusible compounds. In the preferred embodiment, the lower thread material is a material capable of changing phases when heated and/or cooled. The heat from the heating apparatus causes the lower thread material to undergo a phase change from solid to liquid before the material is deposited on the stitching surface. After the lower thread material is deposited in the stitching area, it cools and changes phases from liquid to solid. In a preferred embodiment of the present invention, the apparatus may further include a cooling apparatus that forcibly cools the lower thread material after it has been deposited on the stitching surface.

In a preferred embodiment of the present invention, the needle assembly comprises a needle and a sewing foot, wherein the needle moves the upper thread through the sewing foot and subsequently through the stitching surface.

In a preferred embodiment of the present invention, the looping assembly comprises a shuttle shaft, a shuttle, a case and a hook wherein the shuttle hook is attached to the shuttle and the shuttle moves rotatable around the shuttle shaft.

A further embodiment of the present invention is an application assembly to deposit a continuous supply of lower thread material to a stitching machine comprising a drive mechanism, a lower thread pushed through a container sized and dimensioned such that the lower thread is pushed by the drive mechanism towards the stitching surface, and a mechanism that moves the container towards and away from the stitching surface. Mechanisms may include, but are not limited to, a moveable arm that pivots or a series of reciprocating rollers. In a preferred embodiment, the container is substantially tube shaped and the arm is moved using a pivoting assembly.

In another embodiment of the present invention, a method for forming a stitch is disclosed wherein the method comprises passing an upper thread from a first side to a second side of a stitching surface, forming a loop of the upper thread material on the second side of the stitching surface (opposite the first side), depositing a lower thread material on the second side of the stitching surface and closing the loop of the upper thread around the deposited lower thread material by passing the upper thread from the second side to the first side of the stitching surface.

In a preferred embodiment of this method, the lower thread material is heated with a heating apparatus prior to depositing on the stitching surface and wherein heating causes the lower thread material to undergo a phase change from solid to liquid and subsequent cooling of the lower thread material causes a phase change from liquid back to solid. A cooling apparatus may further forcibly cool the lower thread material. The lower thread material can be a material capable of changing phases when heated and/or cooled.

DETAILED DESCRIPTION

Figure 1:
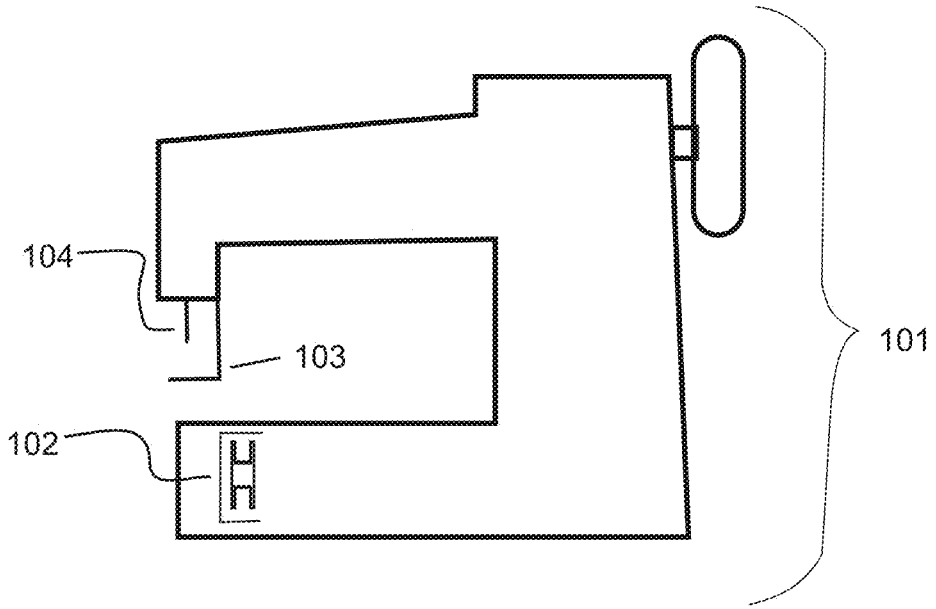
FIG. 1 is an illustration of a traditional sewing machine

Turning to FIG. 1, a traditional sewing machine 101 is depicted wherein the needle 104 and sewing foot 103 are engaged in combination with a spool assembly 102 to form a stitch in a stitching surface, such as a piece of fabric, when the fabric is passed between the sewing foot 103 and the bobbin assembly 102. While the upper thread material passed through 104 can be continuous, the thread used in the bobbin assembly 102 is limited to what will fit on the bobbin and must be changed or replaced frequently, thereby slowing down the stitching process.

Figure 2:
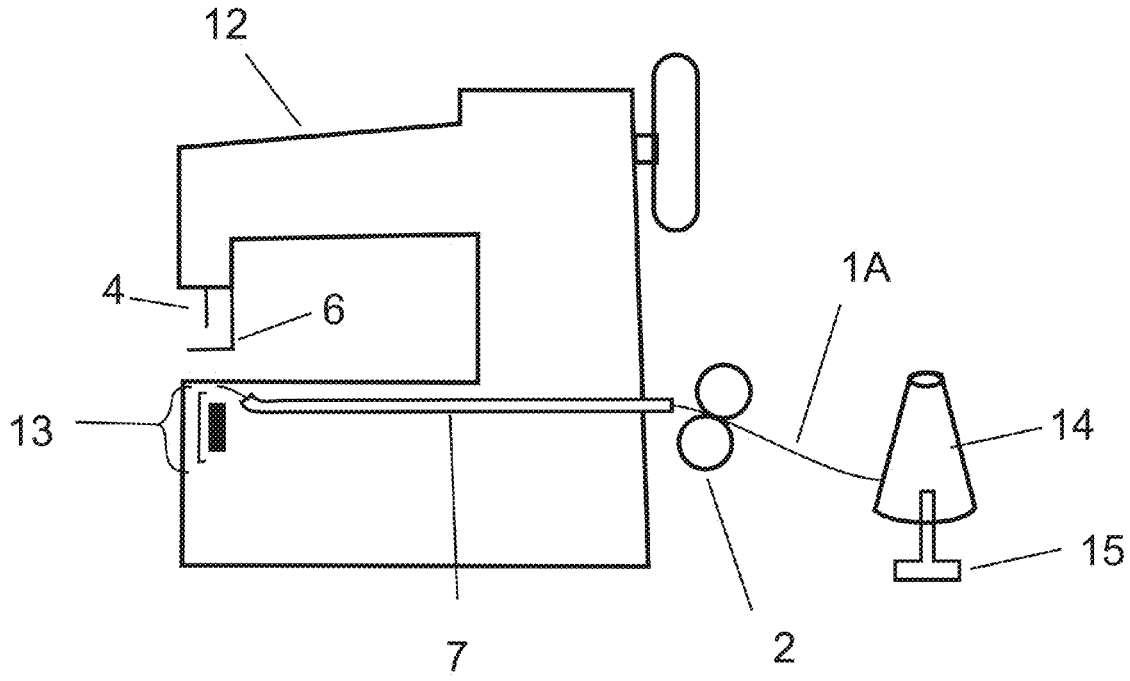
FIG. 2 is a basic illustration of new material being driven into position from bulk spool.

Turning to FIG. 2, according to the present invention, a spool-less continuous bobbin assembly is used to eliminate the use of a bobbin spool with a limited amount of thread. The spool for the bobbin material 14 is located exterior to the sewing/embroidery machine 12 and the spool may sit atop a bracket 15 to hold the spool. This allows for the use of larger skeins of fabric and eliminates the frequency required to replace the lower thread fabric as is required by traditional bobbin assemblies. The lower thread material 1A enters a drive/pump mechanism 2 that inserts material 1A by rolling; pumping; or pushing the material into the machine 12. The lower thread material 1A moves through a container 7 sized and dimensioned such that the lower thread is pushed by the drive mechanism. In the preferred embodiment, the container 7 is substantially cylindrical or "tube" shaped. The lower thread exits the container 7 and enters the stitching area 13.

Figure 3:
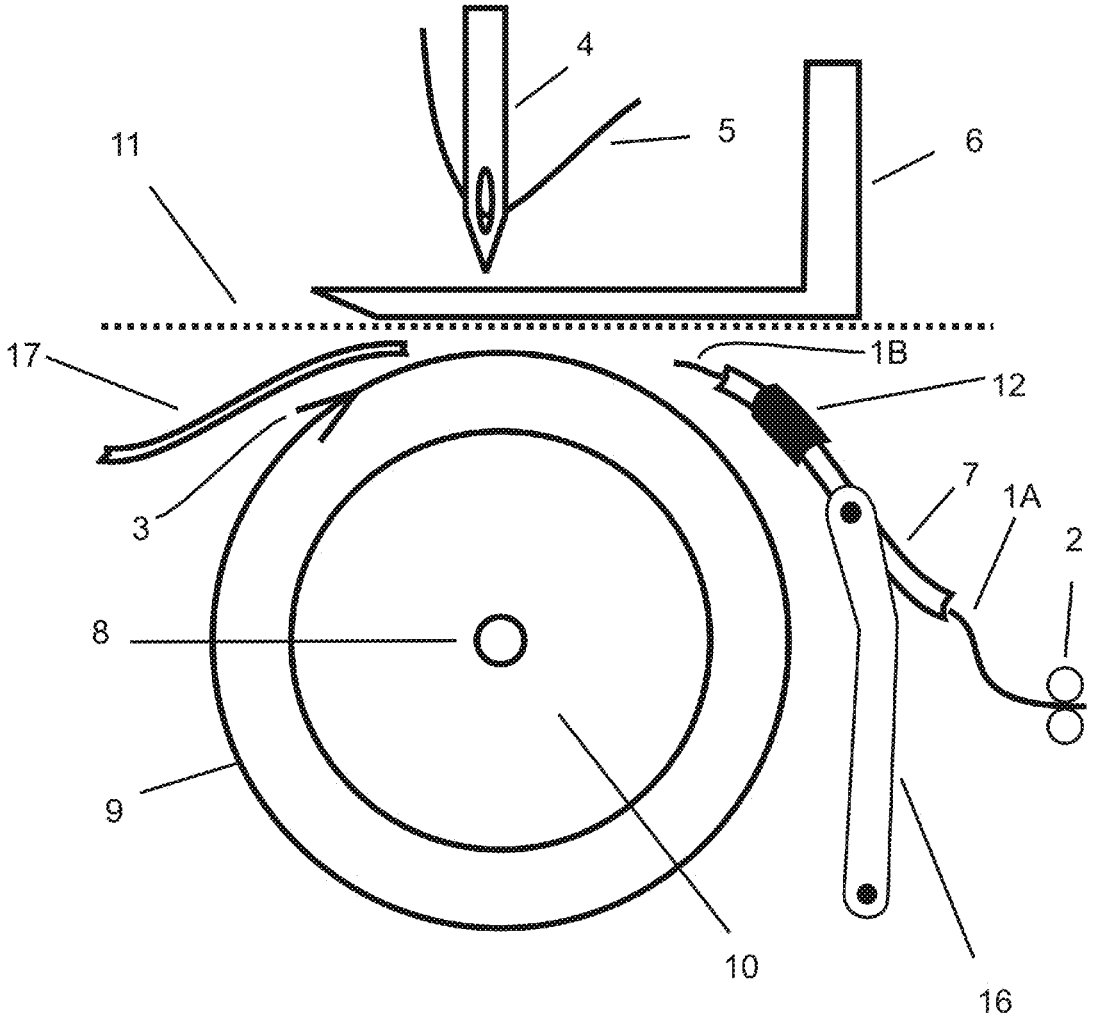
FIG. 3 is a detailed illustration of the components of the present invention at the beginning of a sewing cycle.

Turning to FIG. 3, the needle assembly, looping assembly and the application assembly of the spool-less bobbin apparatus of the present invention are all shown at the beginning of the sewing/embroidery cycle. The needle assembly is shown in the preferred embodiment wherein an upper thread 5 is threaded through a needle 4 and is located above a sewing foot 6 that is further located above a stitching surface 11. The looping assembly is shown in the preferred embodiment wherein a hook 3 is attached to the exterior of a shuttle 8, which rotates around a shuttle shaft 8. The hook 3, shuttle 8 and shuttle shaft 8 are all contained inside a case 10. In the preferred embodiment, the case is substantially circular in shape and generally fits in the space of a sewing/embroidery machine that would typically house a bobbin case. The application assembly is shown in the preferred embodiment wherein lower thread material 1A is driven into a container 7 using a drive mechanism 2. The drive mechanism 2 may be any mechanism well known in the prior art that may roll, pump or push the lower thread material 1A into container 7, such as a series of gripping wheels that when turned, move the fabric forwards or backwards, depending on which way the wheels are moved. The container 7 may be of any shape or size, but in the preferred embodiment is substantially cylindrical, creating a "tube" for lower thread material 1A.

Figure 7:
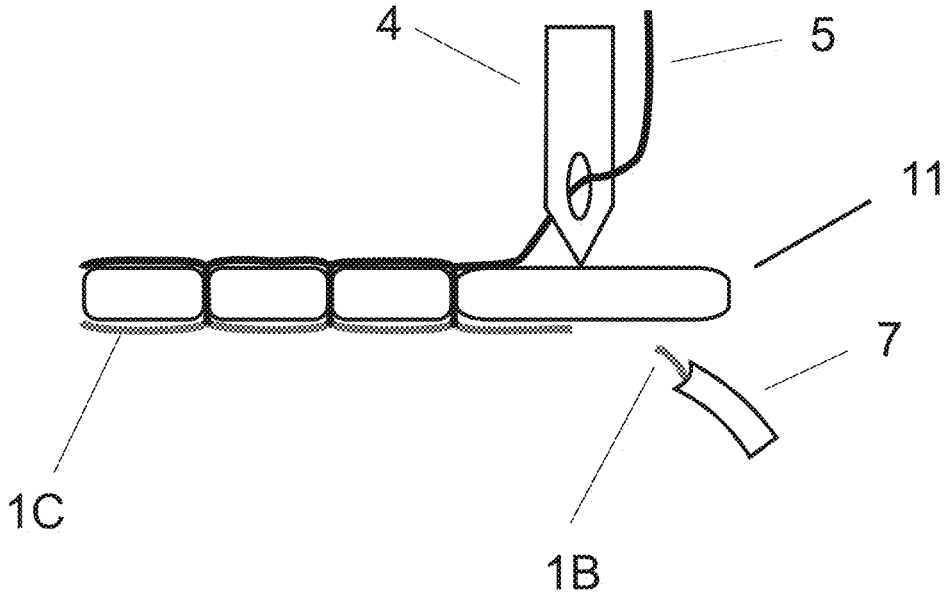
FIG. 7 is a detailed illustration of a close-up of the needle beginning to penetrate the fabric with the upper thread.

As shown in FIGS. 3 and 7, in one embodiment of the present invention, the spool-less bobbin apparatus may further comprise a heating apparatus 12 to heat the lower thread material 1A. The heating apparatus may be any heating apparatus well known in the prior art, such as the heating element commonly used to heat glue in a glue gun. In the preferred embodiment, the heating apparatus 12 is located on the end opposite the drive mechanism 2 inside container 7. The lower thread material 1A can be a material capable of changing phases when heated and/or cooled. Examples of a suitable lower thread material include but are not limited to polyester, nylon, acrylic, copolymer or mixtures thereof. The heat from the heating apparatus 12 causes the lower thread material 1A to undergo a phase change from solid to liquid resulting in lower thread material 1B being deposited on the stitching surface 11. After the lower thread material 1B is deposited on the stitching surface 11, it cools and changes phases from liquid to solid. In a preferred embodiment of the present invention, the apparatus may further include a cooling apparatus 17 that forcibly cools the lower thread material after it has been deposited on the stitching surface. The cooling apparatus may be any apparatus well known in the prior art, such as an air activator.

Figure 4:
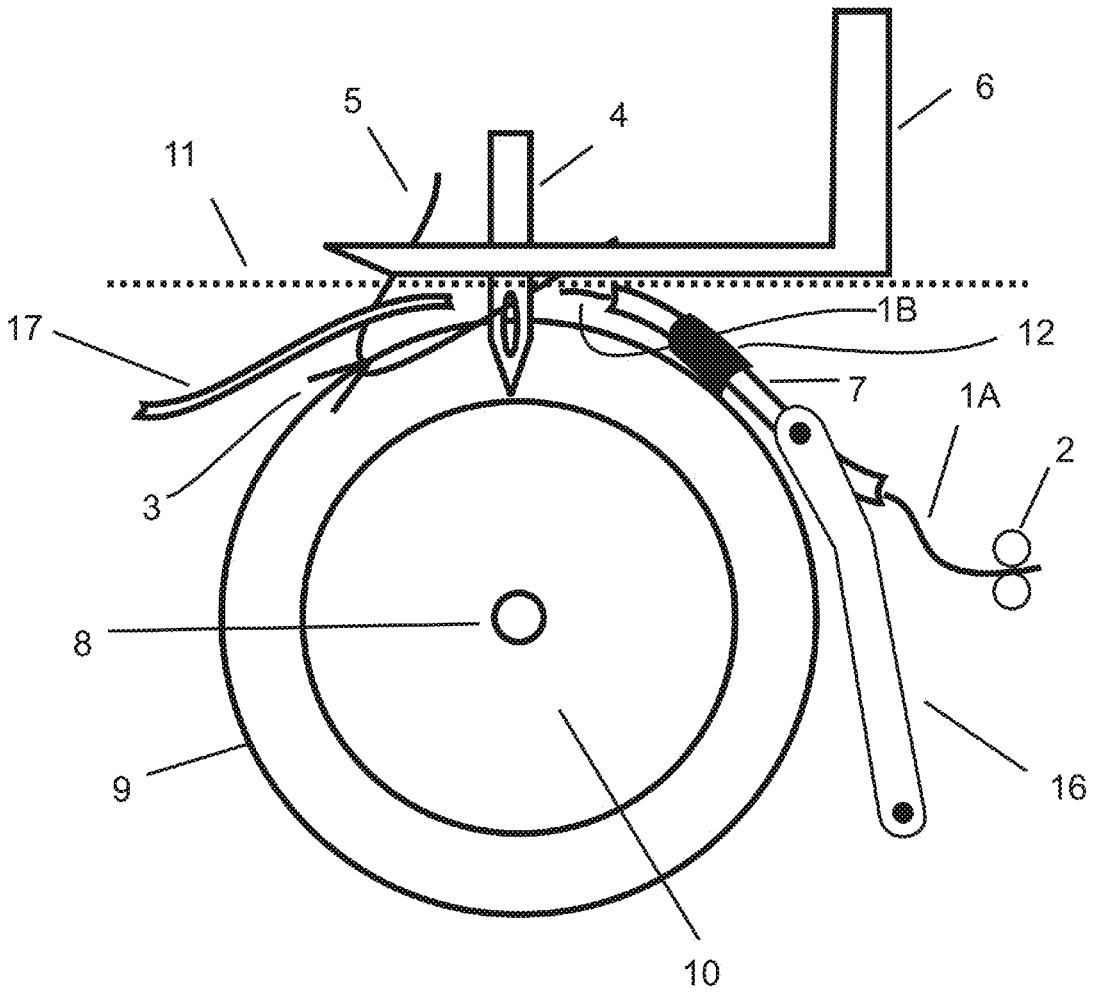
FIG. 4 is a detailed illustration of the components of the present invention as the cycle forms a loop of the upper thread and the application assembly moves into place.

Turning to FIG. 4, the needle and loop assembly generally move to make a loop of the upper thread 5, while the application assembly moves into place to deposit heated lower thread material 1B. The needle 4 moves through sewing foot 6 and further through stitching surface 11, thereby driving thread 5 to the opposite side of the stitching surface. The shuttle 9 of the looping assembly rotates around the shuttle shaft 8, thereby moving the hook 3 such that it engages with upper thread 5 and forms a loop below stitching surface 11. The application assembly moves into place wherein an arm 16 moves the container 7 towards the stitching surface 11. The lower thread material 1A is moved through container 7 using drive mechanism 2, is heated by heating apparatus 12 and exits container 7 as heated lower thread material 1B on stitching surface 11.

Figure 5:
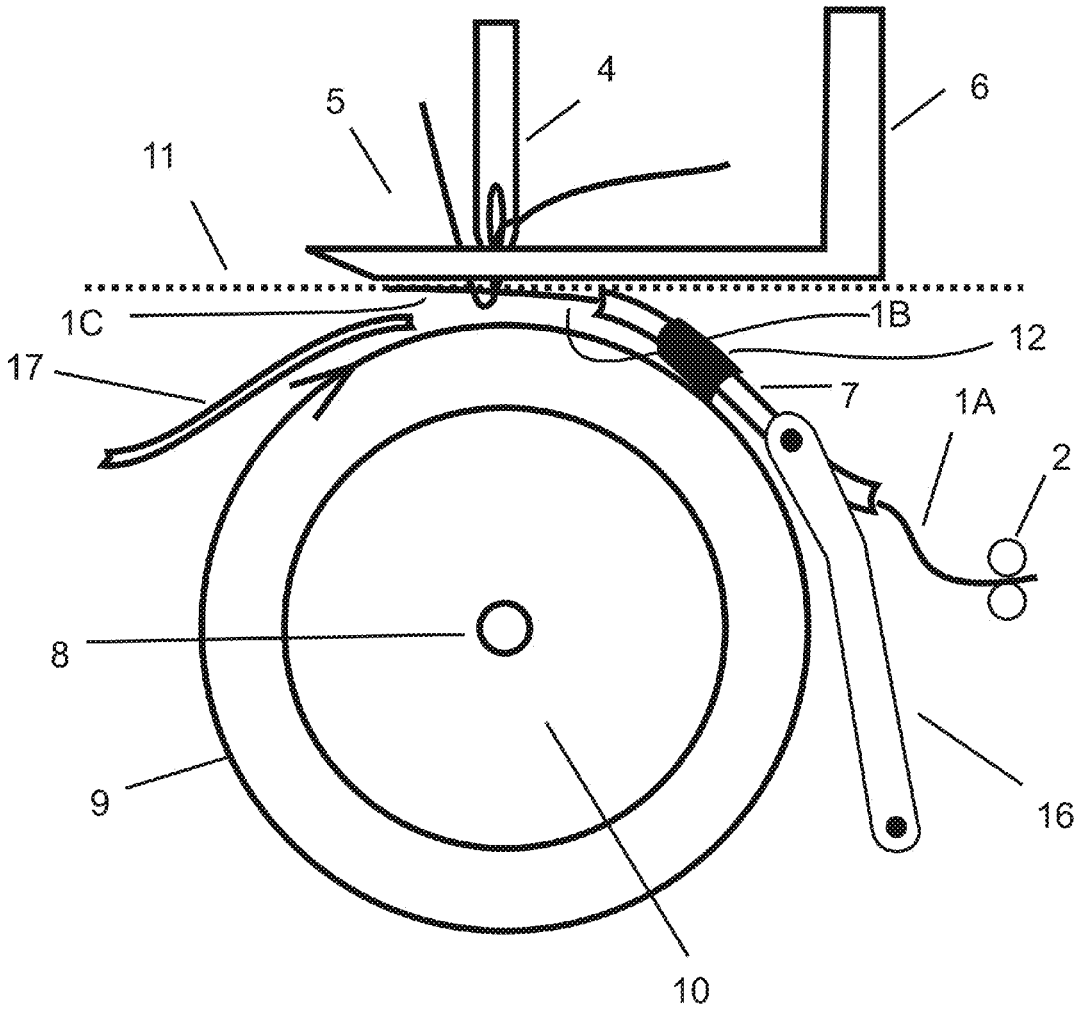
FIG. 5 is a detailed illustration of the lower thread material being deposited as the loop closes.

Turning to FIG. 5, the heated lower thread material 1B is shown being deposited onto stitching surface 11. The loop formed in upper thread 5 below stitching surface 11 is closed when the needle 4 passes back through the stitching surface 11 and subsequently back through sewing foot 6 to move toward the original position of the needle 4 prior to the beginning of the stitching cycle. The heated lower thread material 1B is cooled either by the existing ambient temperature, or alternatively, cooled by a cooling apparatus 17 to produce a bead of lower thread material 1C deposited on the stitching surface 11.

Figure 6:
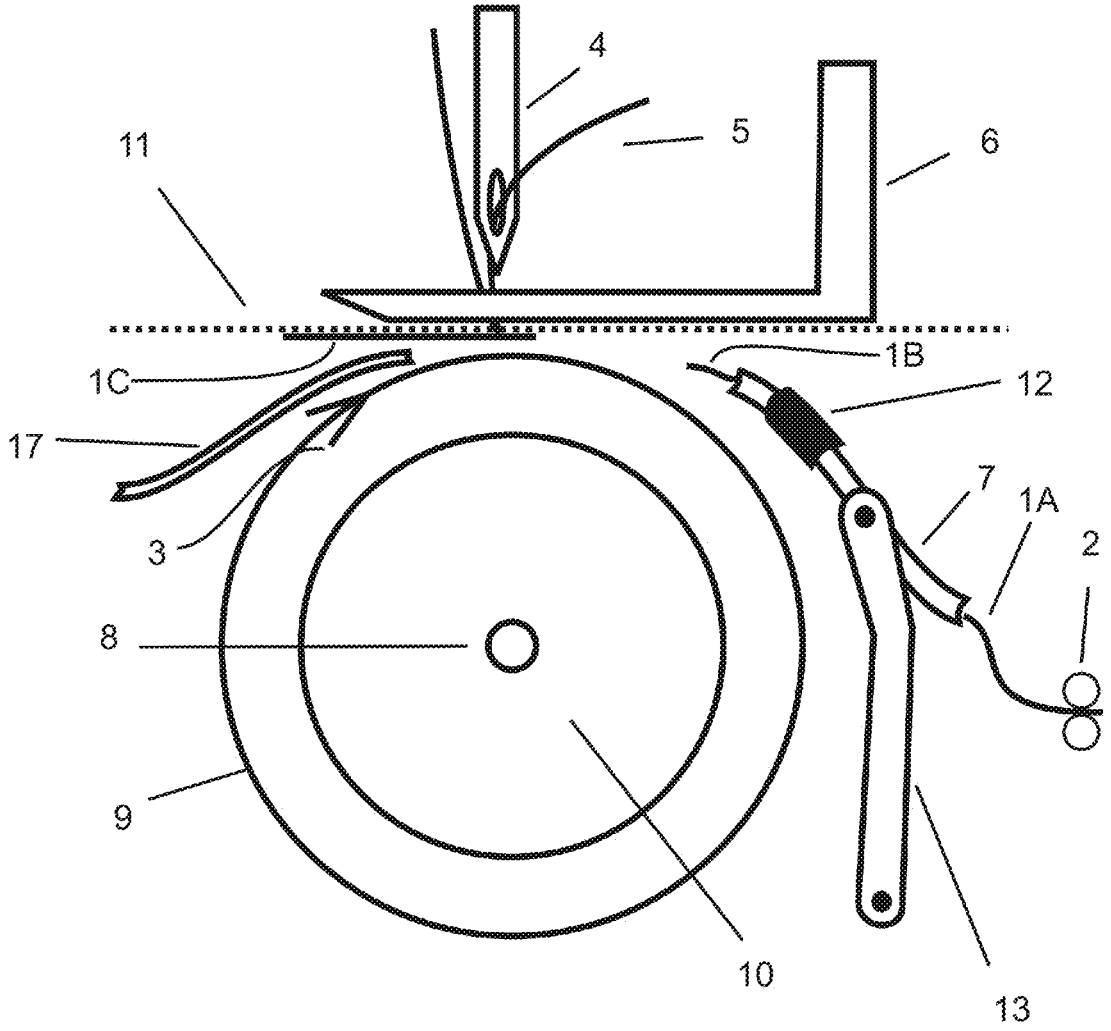
FIG. 6 is a detailed illustration of the end of cycle where the application assembly moves back to home position, breaking contact with previously deposited material as needle retracts, tightening upper thread.

Turning to FIG. 6, the stitching cycle is completed as the needle 4 is in the original position prior to the beginning of the stitching cycle. The loop of upper thread 5 is closed around the newly deposited bead of lower thread material 1C and the hook 3 is disengaged from upper thread 5. The arm 16 moves the container 7 away from the stitching surface, thereby breaking off bead of lower thread material 1C from heated lower thread material 1B. The result is a stitch in the stitching surface made from upper thread 5 and bead of lower thread material 1C, wherein the upper thread may be embedded within the bead of lower thread material 1C. The process can now be repeated to form a series of stitches.

Figure 8:
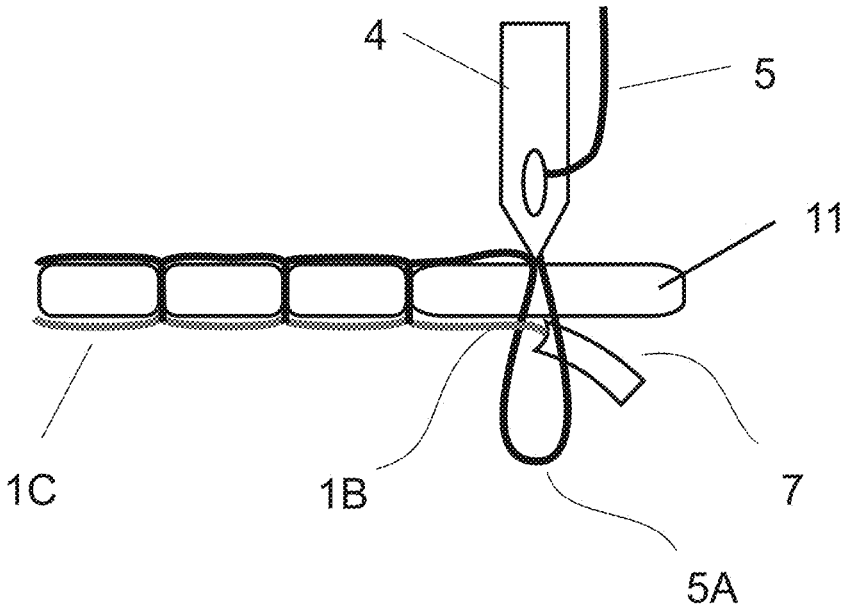
FIG. 8 is a detailed illustration of the needle retracting with the upper thread in a loop position, with the application assembly in position to deposit material.
Figure 9:
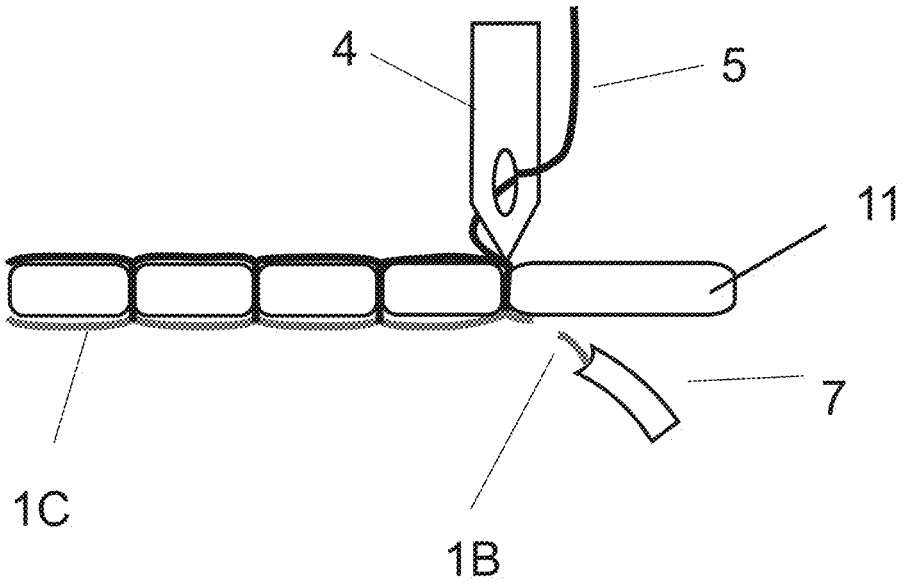
FIG. 9 is a detailed illustration of the end of cycle with the application assembly moved home, the needle fully retracted drawing the upper thread into position to complete the stitch.

FIGS. 7-9 illustrate an expanded view of the stitching surface. In FIG. 7, the heated lower thread material 1B is waiting the start of the stitching cycle as it exits container 7, wherein subsequent cycles have already deposited beads of lower thread material 1C that form a stitch by being looped by upper thread 5 on stitching surface 11. As shown in FIG. 8, the container 7 moves the heated lower thread material 1B into place and needle 4 passes the upper thread 5 through the stitching surface 11 where a loop 5A is created in the upper thread 5 using the looping assembly shown further in FIGS. 3-6. As shown in FIG. 9, at the end of the stitching cycle, bead of lower thread material 1C has been deposited onto stitching surface 11 and loop of upper thread 5 has been closed by passing needle 4 back through stitching surface 11 to its position prior to the initiation of the stitching cycle. Container 7 is moved away from the stitching surface 11 using the application assembly shown further in FIGS. 3-6, thereby severing heated lower material 1B from the bead of lower thread material 1C. The process can now be repeated to form a series of stitches.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

The invention claimed is:

1. A spool-less bobbin apparatus for forming a stitch comprising a needle assembly for an upper thread; a looping assembly for the upper thread; and an application assembly for depositing a lower thread material onto a stitching surface wherein said application assembly to deposit the lower thread material onto the stitching surface comprises a drive mechanism, a container sized and dimensioned such that said lower thread is pushed through the container by the drive mechanism, a mechanism to move the container towards and away from said stitching surface and a heating apparatus inside said container.

2. The apparatus of claim 1 further comprising a heating apparatus to heat said lower thread material.

3. The apparatus of claim 2 further comprising a cooling apparatus to cool said lower thread material.

4. The apparatus of claim 1 wherein the needle assembly comprises a needle and a sewing foot wherein the needle moves said upper thread through the sewing foot and subsequently through a stitching surface.

5. The apparatus of claim 1 wherein the looping assembly comprises a shuttle shaft, a shuttle, a case and a hook, which is attached or part of the shuttle.

6. The assembly according to claim 5 wherein said hook is attached to the exterior of said shuttle with a hook and said shuttle with a hook moves rotatable around said shuttle shaft and wherein said shuttle shaft and shuttle with a hook are surrounded by said case.

7. The apparatus of claim 2 wherein said lower thread material undergoes a phase change when heated by said heating apparatus.

8. The apparatus of claim 3 wherein said lower thread material undergoes a phase change when cooled by said cooling apparatus.

9. The apparatus of claim 1 wherein said lower thread material selected from the group comprising polyester, nylon, acrylic, polymers, copolymers or mixtures thereof.

* * * * *